US010636606B1

(12) United States Patent
Like

(10) Patent No.: US 10,636,606 B1
(45) Date of Patent: Apr. 28, 2020

(54) FUSE HOUSING ASSEMBLY

(71) Applicant: Sumitomo Wiring Systems, Ltd., Yokkaichi, Mie (JP)

(72) Inventor: Nathan Like, Farmington Hills, MI (US)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 16/289,743

(22) Filed: Mar. 1, 2019

(51) Int. Cl.
*H01H 85/165* (2006.01)
*H01H 85/055* (2006.01)
*H01H 85/02* (2006.01)
*H01H 85/041* (2006.01)

(52) U.S. Cl.
CPC ..... *H01H 85/165* (2013.01); *H01H 85/0241* (2013.01); *H01H 85/055* (2013.01); *H01H 2085/0275* (2013.01); *H01H 2085/0414* (2013.01); *H01H 2085/0555* (2013.01)

(58) Field of Classification Search
CPC ..... H01H 85/165; H01H 85/0241; H01H 85/055; H01H 2085/0555; H01H 2085/0275; H01H 2085/0414; H01H 85/2015; H01H 85/20; H01H 85/203; H01H 85/0456; H01H 85/36
USPC ..... 337/186, 194, 198, 208, 209, 260, 264, 337/271
See application file for complete search history.

(56) References Cited

U.S. PATENT DOCUMENTS 4,612,529 A * 9/1986 Gurevich ..... H01H 85/0417 337/255
5,790,007 A * 8/1998 Yasukuni ..... H01H 85/0411 29/623
5,841,338 A * 11/1998 Yasukuni ..... H01H 85/0411 337/293
5,877,944 A * 3/1999 Onizuka ..... H01H 85/20 361/644
6,272,000 B1 * 8/2001 Spaunhorst ..... H01H 85/0417 361/104
D461,781 S * 8/2002 Fukumori ..... H01H 85/2035 D13/161
6,796,808 B2 * 9/2004 Hosoe ..... H01R 9/226 361/826
9,545,001 B2 * 1/2017 Goto ..... H05K 1/11
2002/0115347 A1 * 8/2002 Fukumori ..... H01H 85/2035 439/620.34
2002/0115348 A1 * 8/2002 Fukumori ..... H01H 85/2035 439/620.34
2002/0115349 A1 * 8/2002 Fukumori ..... H01H 85/2035 439/620.27
2002/0137368 A1 * 9/2002 Sumida ..... B60R 16/0239 439/76.2

(Continued)

*Primary Examiner* — Jayprakash N Gandhi
*Assistant Examiner* — Stephen S Sul
(74) *Attorney, Agent, or Firm* — Honigman LLP

(57) ABSTRACT

A fuse housing assembly and a fuse kit are provided. The fuse housing assembly and the fuse kit are configured to allow for fuses having terminals of different sizes to be mounted onto a circuit board. The fuse housing assembly and the fuse kit include a spacer configured to protect the exposed portions of the fuse terminals from the environment and prevent the proximal ends of the fuse terminals from breaking the fuse elements. Further, the spacer retains the fuse body of the respective fuses and the fuse terminals in a fixed position relative to each other so as to prevent the fuse terminals from being bent.

14 Claims, 4 Drawing Sheets

(56) References Cited

U.S. PATENT DOCUMENTS

| | | | | |
|---|---|---|---|---|
| 2003/0133273 | A1* | 7/2003 | Nagaoka | H01H 85/2035<br>361/752 |
| 2006/0119463 | A1* | 6/2006 | Kubota | H01H 85/2035<br>337/182 |
| 2008/0278276 | A1* | 11/2008 | Banzo | H01H 85/0417<br>337/186 |

* cited by examiner

FIG. 1
PRIOR ART
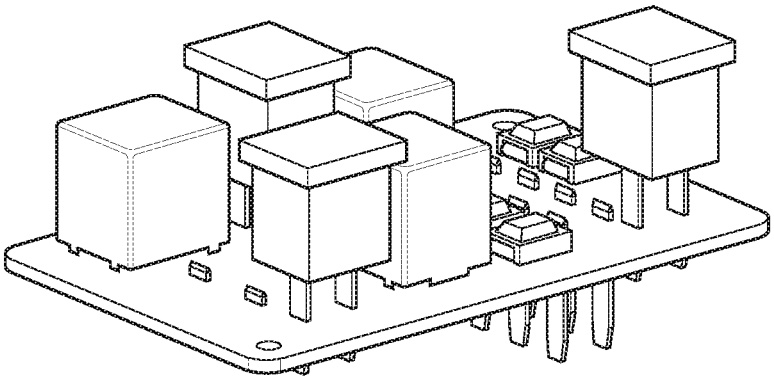
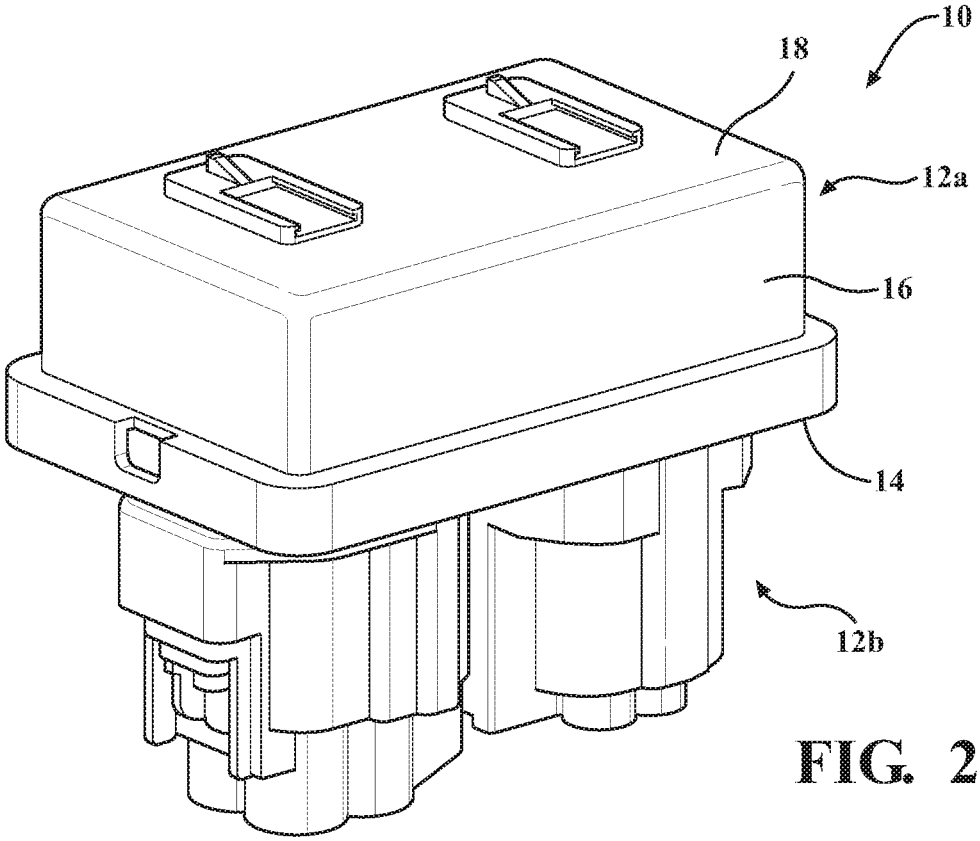
FIG. 2

FUSE HOUSING ASSEMBLY

TECHNICAL FIELD

The present specification generally relates to a fuse housing assembly and more particular to a fuse housing assembly with spacers configured to protect an exposed portion of a terminal and to prevent the terminal from breaking the fuse element.

BACKGROUND

Fuse housing assembly are used to protect electrical systems from power surges. The fuse housing assembly includes a circuit board having a plurality of terminal slots configured to receive the engagement ends of a terminal of a fuse. The terminals have a proximal end which is seated within a body of a fuse.

With reference now to FIG. 1 a depiction of a fuse housing assembly of the prior art is provided. The fuse housing assembly may include a plurality of fuses having different current specifications. As such, some of the fuses are dimensioned to be different sizes than the others so as to accommodate different currents. Thus, the fitting of the terminals within the terminal openings of a printed circuit board may result in portions of terminals being exposed. This may result in an electric failure in instances where the terminals are exposed to water, debris and the light.

Further, the fuse includes a fuse body having a pair of fuse slots configured to receive a proximal end of a respective terminal. A fuse element is disposed on a top portion of the fuse body and is configured to be in electric communication with the respective terminal so as to complete an electric connection. When mounting the fuse body onto the terminal, care must be taken to prevent the proximal end of the terminal from being seated too far into the fuse body so as to prevent the proximal end of the terminal from breaking the fuse element. Such a problem may be further exacerbated when using terminals having a length longer than the length of the fuse slots.

According, it remains desirable to have a fuse housing assembly and a fuse kit wherein, terminals of different lengths may be used and protected so as to maintain the functionality of the respective terminals. It further remains desirable to have a fuse housing assembly and a fuse kit wherein the fuse body is limited in engagement with the terminal so as to prevent the terminal from breaking the fuse element.

SUMMARY

A fuse housing assembly is provided. The fuse housing assembly includes a circuit board having a terminal opening configured to receive a fuse terminal. The circuit board has a thickness and the terminal opening has a height equal to the thickness so as to be open on both sides of the circuit board.

The fuse includes a fuse body configured to be mounted onto the fuse terminal. The fuse terminal is partially seated within the fuse body so as to extend from an underside of the fuse body. The fuse terminal has an engagement portion, a nested portion and an exposed portion. The engagement portion is configured to be seated within the terminal opening of the circuit board, and the nested portion is configured to be seated within the fuse body, wherein the fuse body is displaced above the circuit board a height equal to the length of the exposed portion.

The fuse housing assembly further includes a spacer having a support. The support is configured to receive the exposed portion of the terminal. In particular, the support has a support slot having a height equal to the length of the exposed portion of the fuse terminal. The exposed portion of the fuse terminal is seated within the support slot so as to be protected by the spacer. The support further limits the advancement of the fuse body with respect to the fuse terminal so as to keep a proximal end of the nested portion of the terminal spaced apart from a fuse element of the fuse.

In one aspect, the spacer includes a housing. The housing is integrally formed to a top portion of the support. The housing is configured to hold the fuse body so as to provide stability to the fuse and help prevent the fuse terminals from being bent.

In another embodiment, a fuse kit is provided. The fuse kit is configured to be mounted onto a circuit board. The circuit board includes a plurality of terminal openings that are dimensioned the same as each other. The fuse kit includes a first fuse and a second fuse, each having a fuse body and a fuse slot. The first and second fuses further include a fuse element disposed within the fuse body. The first and second fuses include a first fuse terminal and a second fuse terminal. The second fuse terminal is longer than the first fuse terminal. The first and second fuse terminals each have an engagement portion, a nested portion and an exposed portion.

The engagement portion of the first and second fuse terminals are configured to be seated within the terminal openings of the circuit board so as to place the first and second fuse bodies above the circuit board, a height equal to the length of the respective exposed portion of the corresponding first and second fuse terminals.

The kit further includes a first spacer and a second spacer. The first and second spacer each have a support. Each support includes a fuse slot having a height equal to the exposed portion of the corresponding first and second fuse terminals so as to protect the exposed portions of the first and second terminals from weather, debris and the light. Further, the first and second spacers limit the advancement of the corresponding fuse body with respect to the first and second fuse terminals so as to keep a proximal end of the nested portion of the terminal spaced apart from a respective fuse element of the first and second fuses.

Accordingly, a fuse housing assembly and fuse kit are provided that allows for different length terminals to be used, wherein the exposed portions of the terminals are protected by a spacer and the proximal end of the fuse terminal is prevented from breaking the fuse element. In another aspect, the fuse housing assembly and fuse kit include a spacer configured to hold the fuse body so as to retain the fuse body and the fuse terminals in a fixed relationship with each other, thereby preventing the fuse terminals from being bent.

BRIEF DESCRIPTION OF THE DRAWINGS

The embodiments set forth in the drawings are illustrative and exemplary in nature and not intended to limit the subject matter defined by the claims. The following description of the illustrative embodiments can be understood when read in conjunction with the following drawings, where like structure is indicated with like reference numerals and in which:

FIG. 1 is a perspective view of a fuse housing assemble of the prior art;

FIG. 2 is a perspective view of the fuse housing assembly according to one or more illustrative embodiment described herein;

DETAILED DESCRIPTION OF PREFERRED EMBODIMENTS

Figure 3:
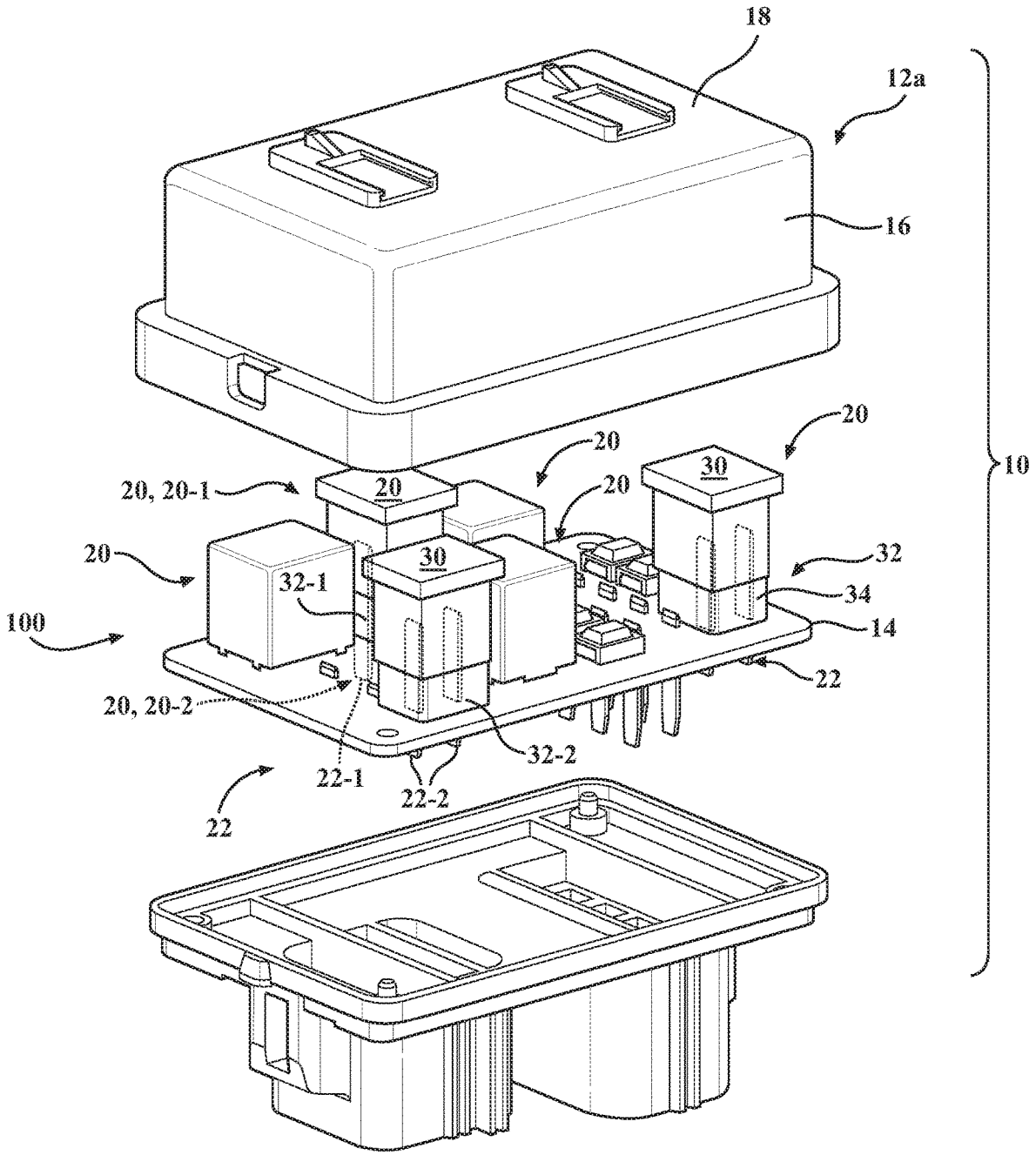
FIG. 3 is an exploded view of the fuse housing assembly shown in FIG. 2.

Referring generally to the figures, embodiments of a fuse housing assembly and a fuse kit are provided. The fuse housing assembly and the fuse kit are configured to allow for fuses having terminals of different sizes to be mounted onto a circuit board. A spacer protects the exposed portions of the fuse terminals from the environment and prevents the proximal ends of the fuse terminals from breaking the fuse elements. Further, the spacer retains the fuse body of the respective fuses and the fuse terminals in a fixed position relative to each other so as to prevent the fuse terminals from being bent.

With reference now to FIG. 2, a perspective view of a fuse housing assembly 10 is illustratively provided. The fuse housing assembly 10 includes a top cover 12*a* mounted to a printed circuit board 14. A bottom cover 12*b* supports the printed circuit board 14. The cover 12 includes a peripheral wall 16 and a top wall 18 so as to define a cavity (not shown) for containing a plurality of fuses 20. The fuse housing assembly 10 further includes fuse terminals 22. The fuse terminals 22 are configured to be seated within the printed circuit board 14, as will be described in greater detail below.

With reference now to FIG. 3, an illustrative depiction showing the plurality of fuses 20 mounted to the printed circuit board 14. The fuses 20 have different current specifications and thus different current regulatory functions. As used herein, the term "current regulatory function" references the current the fuse 20 is configured to limit so as to prevent a power surge from disabling an electric system. For instances, fuses 20 marked "30" are configured to break when a current greater than 30 amps is passed through the fuse 20, likewise fuses 20 marked "20" are configured to break when a current greater than 20 amps is passed through the fuse 20. It should be appreciated that the fuses 20 within the scope of the appended claims may have a current regulatory function different than what is expressly stated herein and the fuses 20 may be configured to limit greater or lower currents based upon the design specifications of the electric system which the fuse housing assembly 10 is configured to protect.

Figure 7:
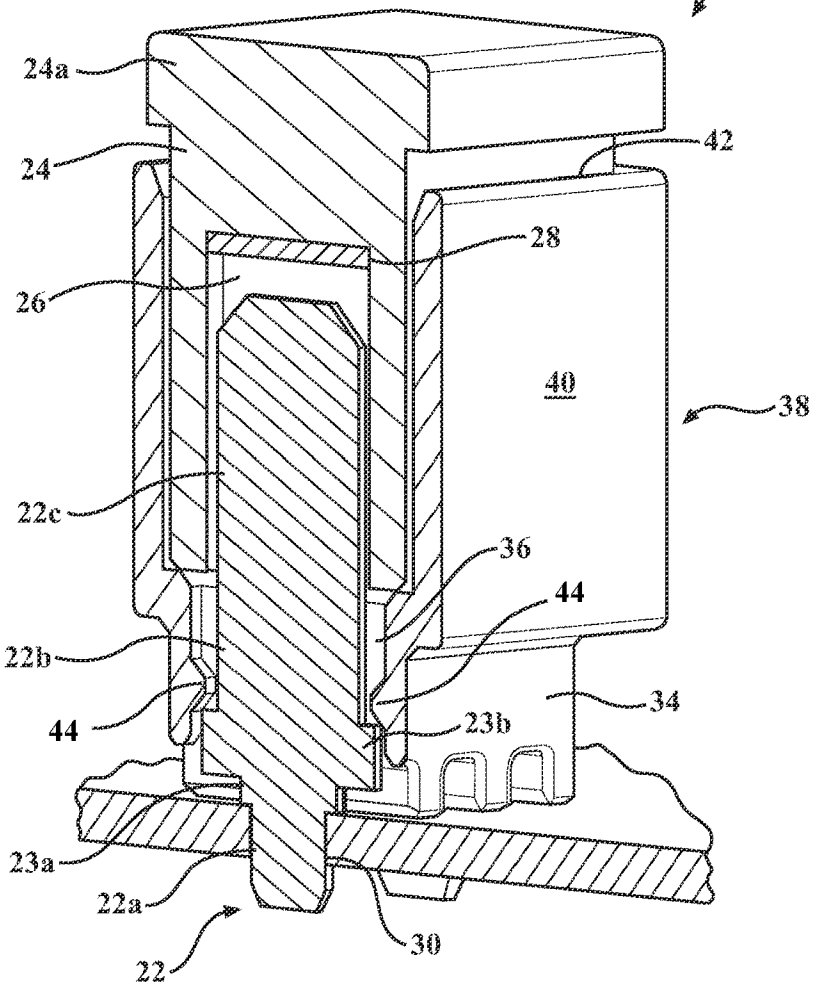
FIG. 7 is a cross-sectional view of the fuse shown in FIG. 4 taken along line 7-7.
Figure 6:
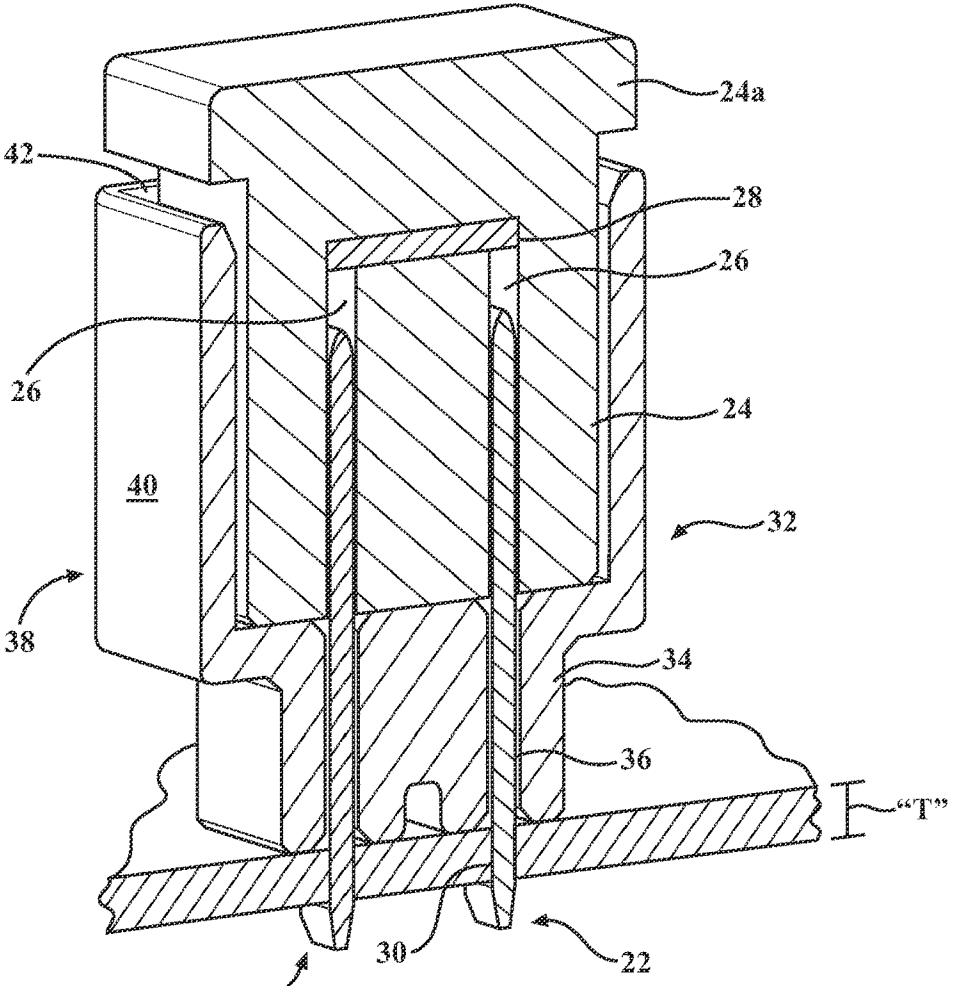
FIG. 6 is a cross-sectional view of the fuse shown in FIG. 4 taken along line 6-6.

With reference again to FIG. 3 and also to FIGS. 6 and 7, the fuse 20 includes a fuse body 24 having a fuse slot 26. A fuse element 28 is disposed in the fuse body 24. The fuse slot 26 is a generally elongated opening. The fuse element 28 is disposed on a top portion 24*a* of the fuse body 24 above the fuse slot 26 so as to close off the fuse slot 26.

For illustrative purposes, the fuses 20 are shown as having a pair of fuse slots 26, but it should be appreciated that the fuse 20 may include a single fuse slot 26 or any other number of fuse slots 26 other than what is shown in the figures without deviating from the scope of the appended claims. The fuse slot 26 includes a conductive trace or bus (not shown) electrically connecting the fuse element 28 to the fuse terminal 22 so as to complete an electric connection. The fuse element 28 is illustratively shown as a thin length of wire which is configured to break upon a predetermined current. The fuse element 26 may be pierced and broken if the fuse body 22 is pressed too far down onto the fuse terminal 28.

The fuse terminals 22 are generally elongated and planar conductive members which may be stamped or cut. The fuse terminals 22 include an engagement portion 22*a*, an exposed portion 22*b* and a nested portion 22*c*. The engagement portion 22*a* is configured to be seated in the printed circuit board 14.

Any printed circuit board 14 currently known or later developed may be modified and adapted for use herein. The printed circuit board 14 is a generally planar member having a top surface 14*a* opposite of a bottom surface 14*b*. The printed circuit board 14 includes a plurality of terminal openings 30 which are generally slots extending through a thickness "T" of the printed circuit board 14 so as to be open on the top surface 14*a* and the bottom surface 14*b* of the printed circuit board 14.

The engagement portion 22*a* of the fuse terminal 22 is a generally T-shaped member having a neck portion 23*a* and a pair of shoulders 23*b* orthogonal to the neck portion 23*a*. The neck portion 23*a* is configured to be seated against the terminal opening 30 and abut against a top surface of the printed circuit board 14 so as to limit advancement of the fuse terminal 22 with respect to the printed circuit board 14.

Figure 4:
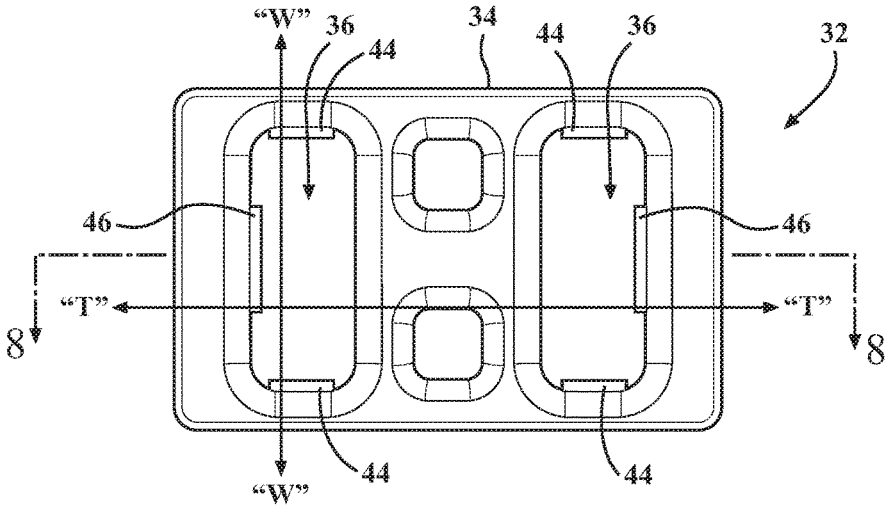
FIG. 4 is a top down view of the spacer shown in FIG. 3.
Figure 5:
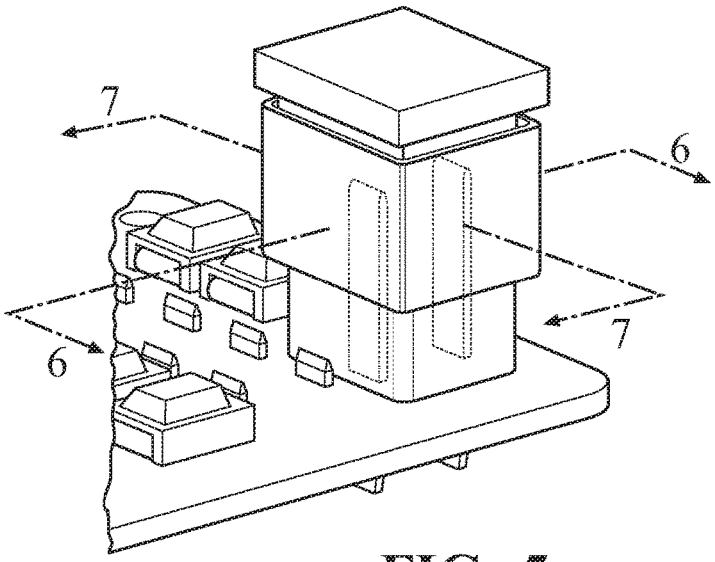
FIG. 5 is an isolated view showing the fuse and spacer mounted to the printed circuit board.

The fuses 20 may be purchased off the shelf and in such cases, the fuse terminals 22 are also purchased separately. The fuse terminals 22 may have different dimensions based upon the current requirements of the fuse 20. Thus, FIG. 4 shows how different lengths and thicknesses of the fuse terminals 22 displace the fuse body 24 in different positions relative to the printed circuit board 14. In particular, some of the fuses 20 such as the fuses 20 marked "30" are spaced further apart from or elevated higher relative to the printed circuit board 14 than the fuses 20 marked "10".

The printed circuit board 14 may be any printed circuit board 14 currently known and used in the art and may include an electric trace printed on a top surface of the circuit board. The printed circuit board 14 includes a plurality of terminal openings 30 which are generally slots having an open end on the top surface 14*a* of the circuit board and the bottom surface 14*b* of the printed circuit board 14. The printed circuit board 14 has a thickness indicated by "T" and the slot defining the terminal opening 30 has a height equal to the thickness "T" of the printed circuit board 14. The engagement portion 22*a* is seated within the terminal opening 30 wherein the fuse body 24 is displace above the top surface 14*a* of the printed circuit board 14 a height equal to a length of the exposed portion 22*b*. The terminal openings 30 are uniform in dimension but may be oriented along different axes. For instance, some of the terminal openings 30 may extend along an axis which is parallel to the side edge of the printed circuit board 14 while others may be orthogonal to the side edges of the printed circuit board 14.

With reference again to FIG. 3 and now also to FIGS. 4-7, the fuse housing assembly 10 further includes a spacer 32. The spacer 32 is preferably formed of a non-conductive material suitable for the injection molding process so as to be made as a unitary piece. Any materials suitable for use in the injection molding process may be used illustratively including polypropylene and polyamide.

The spacer 32 includes a support 34. The support 34 is a generally cuboidal member having a support slot 36. The support slot 36 has a generally rectangular has a height equal to that of a corresponding exposed portion 22*b* of the fuse terminal 22. FIG. 6 shows the fuse terminal 22 being seated into respective support slots 36 of the support 34. The engagement portion 22*a* of the fuse terminal 22 extends beyond a bottom surface of the support 34 and is seated within the terminal opening 30.

In one aspect, the spacer 32 may further include a housing portion 38. The housing portion 38 is configured to hold the fuse 20. In particular, the housing portion 38 is configured to hold the fuse body 24. The housing portion 38 is defined by a first wall 40 which bounds the outer surface of the fuse body 24 and includes an open top 42. The fuses 20 are shown as generally being cuboidal members and thus the housing portion 38 defines a cuboidal space configured to receive the fuse body 24. However, it should be appreciated that the housing portion 38 may be dimension otherwise to accommodate fuse bodies 20 of other dimensions.

With reference again the FIG. 6, the housing portion 38 is shown to slidingly receive the fuse body 24 and the nested portion 22*c* of the fuse terminal 22 is mounted within the fuse slot 26 of the fuse body 24. The exposed portion 22*b* projects outwardly from a bottom surface of the fuse body 24 and is seated within the support slot 36 of the support 34 of the spacer 32.

FIG. 6 illustrates how the spacer 32 works with the fuse body 24 to retain the fuse 20 in fixed position with respect to the fuse terminal 22. As such the spacer 32 helps the fuse body 24 and the fuse terminals 20 remain rigid so as to keep the fuse terminal 22 straight and prevent the fuse terminal 22 from bending. Further, the support 34 is configured to retain the fuse element 28 spaced apart from the proximal end of the fuse terminal 22 so as to prevent the fuse terminal 22 from inadvertently piercing the fuse element 28, damaging the fuse 20.

With reference again to FIGS. 4 and 6 now to FIG. 7, in one aspect of the fuse housing assembly 10 the spacer 32 is configured to stabilize the fuse terminal 20. In such an aspect, the spacer 32 includes a pair of first ribs 44. The first ribs 44 are disposed within the support slot 36 along an axis "W" coaxial with the shoulders 23*b*. The first ribs 44 are opposite of each other and are set back from a bottom opening 36*a* of the support slot 36 of the spacer 32 so as to accommodate a height of the shoulders 23*b*. The first ribs 44 cooperate with each other to abut against opposing side edges of the exposed portion 22*b* helping the fuse terminal 22 remain along a vertical axis centered and coaxial with the length of the support slot 36 of the spacer 32. The first ribs 44 further cooperate with the shoulders 23*b* to help prevent the fuse 20 from bending relative to the printed circuit board 14 by preventing a cantilevered force from rotating the fuse terminal 20 about a plane coplanar with the plane of the shoulders 23*b*.

Figure 8:
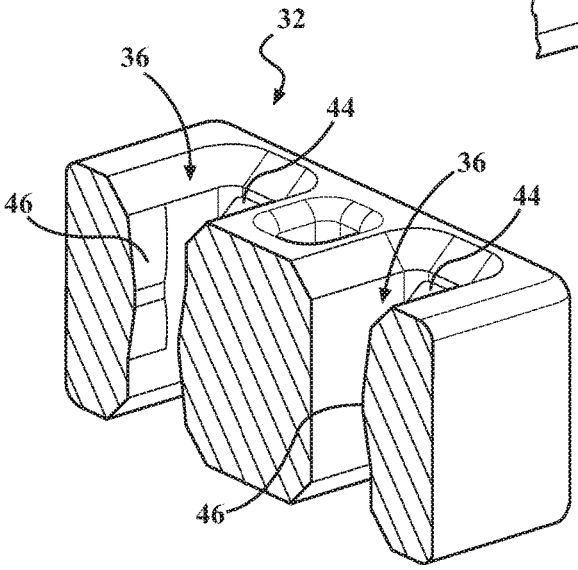
FIG. 8 is a cross-sectional view of the spacer shown in FIG. 4 taken along line 8-8.

With reference again to FIG. 4 now to FIG. 8, in one aspect of the fuse housing assembly 10 the spacer 32 is configured to stabilize the fuse terminal 20 along a plane orthogonal to the plane on which the shoulders 23*b* are disposed. In such an aspect, the spacer 32 includes a pair of second ribs 46. The second ribs 46 are disposed within the support slot 36 along an axis "T" defined by a plane orthogonal to the plane on which the shoulders 23*b* are disposed. The second ribs 46 are opposite of each other and are set back from a bottom opening 36*a* of the support slot 36 of the spacer 32. The second ribs 46 cooperate with each other to abut against opposing surfaces of the exposed portion 22*b* helping the fuse terminal 22 remain along a vertical axis centered and coaxial with the length of the support slot 36 of the spacer 32. The second ribs 46 help prevent the fuse 20 from bending relative to the printed circuit board 14 by preventing a cantilevered force from rotating the fuse terminal 20 about a plane orthogonal with the plane of the shoulders 23*b*.

In another aspect of the disclosure, a fuse kit 100 assembly is provided. A description of the fuse kit 100 will be made with references now to FIGS. 3-8. The fuse kit 100 is configured to be mounted onto a printed circuit board 14. The printed circuit board 14 includes a plurality of terminal openings 30. Each of the terminal openings 30 is dimension the same as the other.

The fuse kit 100 includes a plurality of fuses 20. Each of the fuses 20 are configured to regulate different currents. Each of the fuses 20 includes a fuse body 24 having a fuse slot 26. A fuse element 28 is disposed in the fuse body 24. The fuse slot 26 is a generally elongated opening. The fuse element 28 is disposed on a top portion 24*a* of the fuse body 24 above the fuse slot 26 so as to close off the fuse slot 26.

For illustrative purposes a discussion of the fuse kit 100 will be made referencing two fuses 20, specifically a first fuse 20-1 and a second fuse 20-2. It should be appreciated that the fuse kit 100 may include any number of fuses 20 which are different from each other and may include a number of fuses 20 wherein some of the fuses 20 are the same and others are different. For instance, the fuse kit 100 may have three fuses 20 for preventing a current over 30 amps and two fuses 20 for preventing current over 10 amps, or three fuses 20 each regulating different currents.

The first fuse 20-1 includes a first fuse terminal 22-1 and the second fuse 20-2 includes a second fuse terminal 22-2. The second fuse terminal 22-2 has a length longer than the first fuse terminal 22-1. The first and second fuse terminals 20-1, 20-2 each have an engagement portion 22*a* and an exposed portion 22*b*. The engagement portion 22*a* is configured to be seated within anyone of the plurality of terminal openings 30 so as to place the fuse body 24 of the first and second fuses 20 above the printed circuit board 14 a height equal to the length of the exposed portion 22*b* of the corresponding first and second fuse terminals 22-1, 22-2.

The fuse kit 100 includes a first spacer 32-1 and a second spacer 32-2. Wherein the first and second spacers 32-1, 32-2 each have a support 34. The support 34 includes a support slot 36 having a height equal to the exposed portion 22*b* of the corresponding first and second fuse terminals 22-1, 22-2 so as to protect the exposed portion 22*b* of the first and second fuse terminals 22-1, 22-2 from the environment. Further, the first and second spacers 32-1, 32-2 position the fuse element 28 of the respective first and second fuses 20-1, 20-2 apart from the respective first and second fuse terminals 22-1, 22-2 so as to prevent the first and second fuse terminals 22-1, 22-2 from breaking the fuse element 28. As such, the spacers 32-1, 32-2 have a height which is different from each other and dimensioned to cover 12 the exposed portion 22*b* of the corresponding first and second fuse terminals 22-1, 22-2.

In one aspect, the spacers 32-1, 32-2 may include a housing portion 38. The housing portion 38 may be different from each other in dimension so as to receive the fuse body 24 of corresponding first and second fuses 20-1, 20-2. The housing portion 38 is integrally formed to the support 34 so as to provide a rigid structure. Wherein the fuse body 24 is seated in the housing portion 38 and the terminals are retained in a fixed relationship with the fuse body 24.

In one aspect of the fuse kit 100, the spacer 32 is configured to stabilize the fuse terminals 20-1, 20-2. In such an aspect, the spacer 32 includes a pair of first ribs 44. The first ribs 44 are disposed within the support slot 36 along an axis "W" coaxial with the shoulders 23*b*. The first ribs 44 are opposite of each other and are set back from a bottom opening 36*a* of the support slot 36 of the spacer 32 so as to accommodate a height of the shoulders 23*b*.

The first ribs 44 cooperate with each other to abut against opposing side edges of the exposed portion 22*b* helping the fuse terminals 20-1, 20-2 remain along a vertical axis centered and coaxial with the length of the support slot 36 of the spacer 32. The first ribs 44 further cooperate with the shoulders 23*b* to help prevent the fuses 20-1, 20-2 from bending relative to the printed circuit board 14 by preventing a cantilevered force from rotating the fuse terminals 20-1, 20-2 about a plane coplanar with the plane of the shoulders 23*b*.

In another aspect of the fuse kit 100 the spacer 32 is configured to stabilize the fuse terminals 20-1, 20-2 along a plane orthogonal to the plane on which the shoulders 23*b* are disposed. In such an aspect, the spacer 32 includes a pair of second ribs 46. The second ribs 46 are disposed within the support slot 36 along an axis "T" defined by a plane orthogonal to the plane on which the shoulders 23*b* are disposed.

The second ribs 46 are opposite of each other and are set back from a bottom opening 36*a* of the support slot 36 of the spacer 32. The second ribs 46 cooperate with each other to abut against opposing surfaces of the exposed portion 22*b* helping the first and second fuse terminals 22-1, 22-2 remain along a vertical axis centered and coaxial with the length of the support slot 36 of the spacer 32. The second ribs 46 help prevent the first and second fuses 20-1, 20-2 from bending relative to the printed circuit board 14 by preventing a cantilevered force from rotating the first and second fuse terminals 20-1, 20-2 about a plane orthogonal with the plane of the shoulders 23*b*.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A fuse housing assembly comprising:

a circuit board having a terminal opening with a thickness;

a fuse having a fuse terminal extending from an underside of the fuse, the fuse terminal having an engagement portion and an exposed portion, the engagement portion configured to be seated within the terminal opening wherein the fuse is displaced above the circuit board at a height equal to a length of the exposed portion of the fuse terminal; and a spacer having a housing portion and a support, the housing portion configured to hold a body of the fuse, the support having a support slot, the support slot having a height equal to the exposed portion of the fuse terminal so as to protect the exposed portion of the fuse terminal, wherein the support includes a diameter that is smaller than a diameter of the housing portion.

2. The fuse housing assembly as set forth in claim 1, wherein the housing portion includes a first wall configured to bound a periphery of the fuse.

3. The fuse housing assembly as set forth in claim 1, wherein the engagement portion includes a pair of shoulders configured to abut against the circuit board so as to limit an advancement of the fuse terminal within the terminal opening, the support having a height equal to a distance between the pair of shoulders and a bottom surface of the body of the fuse.

4. The fuse housing assembly as set forth in claim 3, wherein the support includes a first rib disposed within the support slot, the first rib configured to engage at least one shoulder of the pair of shoulders and a side edge of the exposed portion of the fuse terminal so as to center the fuse terminal within the support slot.

5. The fuse housing assembly as set forth in claim 4, wherein the first rib is a pair of first ribs, each first rib of the pair of first ribs is spaced apart from each other.

6. The fuse housing assembly as set forth in claim 3, wherein the support includes a second rib disposed within the support slot, the second rib configured to engage a first surface of the exposed portion of the fuse terminal so as to center the fuse terminal within the support slot.

7. The fuse housing assembly as set forth in claim 6, wherein the second rib is a pair of second ribs, each second rib of the pair of second ribs is spaced apart from each other, wherein one second rib of the pair of second ribs engages the first surface of the exposed portion of the fuse terminal and the other second rib of the pair of second ribs engages a second surface of the exposed portion of the fuse terminal, the second surface being opposite of the first surface.

8. A fuse kit configured to mount onto a circuit board, the circuit board having a plurality of terminal openings, each of the plurality of terminal openings being dimensioned the same as each other, the fuse kit comprising:

a first fuse having a first fuse terminal and a second fuse having a second fuse terminal, the second fuse terminal having a length longer than the first fuse terminal, the first and second fuse terminals each having an engagement portion and an exposed portion, the engagement portion configured to be seated within any one of the plurality of terminal openings so as to place the first fuse and the second fuse above the circuit board at a height equal to a length of the exposed portion of the corresponding first and second terminal; and a first spacer and a second spacer, the first and second spacers each having a housing portion and a support, the housing portion configured to hold a body of a respective first fuse and second fuse, the support having a support slot, the support slot having a height equal to the exposed portion of the corresponding first and second fuse terminals so as to protect the exposed portion of the first and second fuse terminals, wherein the support of the first space and the second spacer includes a diameter that is smaller than a diameter of the corresponding housing portion of the first spacer and the second spacer.

9. The fuse kit as set forth in claim 8, wherein the housing portion includes a first wall configured to bound a periphery of a corresponding one of the first and the second fuses.

10. The fuse kit as set forth in claim 8, wherein the engagement portion includes a pair of shoulders configured to abut against the circuit board so as to limit an advancement of the respective first and second fuse terminals within a corresponding one of the plurality of terminal openings, the support the first and second spacer having a height equal to a distance between the pair of shoulders and a bottom surface of the corresponding body of the fuse.

11. The fuse kit as set forth in claim 10, wherein the support includes a first rib disposed within the support slot, the first rib configured to engage at least one shoulder of the pair of shoulders and a side edge of the exposed portion of a corresponding one of the first and the second fuse terminals so as to center the first and the second fuse terminals within a respective one of the support slots.

12. The fuse kit as set forth in claim 11, wherein the first rib is a pair of first ribs, each first rib of the pair of first ribs is spaced apart from each other.

13. The fuse kit as set forth in claim 10, wherein the support includes a second rib disposed within the support slot, the second rib configured to engage a first surface of the exposed portion of a corresponding one of the first and second fuse terminals so as to center the first and second fuse terminals within a respective one of the support slot.

14. The fuse kit as set forth in claim 13, wherein the second rib is a pair of second ribs, each second rib of the pair of second ribs is spaced apart from each other, wherein one second rib of the pair of second ribs engages the first surface of the exposed portion of the respective first and second fuse terminals and the other second rib of the pair of second ribs engages a second surface of the exposed portion of the respective first and second fuse terminals, the second surface being opposite of the first surface.

* * * * *